US007681727B2

(12) United States Patent
Hunt et al.

(10) Patent No.: US 7,681,727 B2
(45) Date of Patent: Mar. 23, 2010

(54) PACKAGE FOR SMOKING ARTICLES AND THE LIKE

(75) Inventors: Philip Richard Hunt, Southampton (GB); Steven Holford, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 169 days.

(21) Appl. No.: 11/792,568

(22) PCT Filed: Nov. 23, 2005

(86) PCT No.: PCT/GB2005/004507

§ 371 (c)(1),
(2), (4) Date: Aug. 6, 2007

(87) PCT Pub. No.: WO2006/061563

PCT Pub. Date: Jun. 15, 2006

(65) Prior Publication Data

US 2008/0087712 A1 Apr. 17, 2008

(30) Foreign Application Priority Data

Dec. 7, 2004 (GB) ..... 0426825.6

(51) Int. Cl.
*B65D 5/00* (2006.01)

(52) U.S. Cl. ..... 206/268; 206/273; 206/249; 229/123

(58) Field of Classification Search ..... 206/268, 206/273, 242, 265, 271, 249, 251, 255; 229/123, 229/128, 130, 160.1, 87.13
See application file for complete search history.

(56) References Cited

U.S. PATENT DOCUMENTS 2,929,542 A * 3/1960 O'Gorman ..... 206/268

(Continued)

FOREIGN PATENT DOCUMENTS

DE 7921550 12/1979

(Continued)

*Primary Examiner*—Ehud Gartenberg
*Assistant Examiner*—Andrew Perreault
(74) *Attorney, Agent, or Firm*—Charles I. Sherman; Middleton Reutlinger

(57) ABSTRACT

A packet comprises an outer shell (0) and an inner shell (I) connected by a spring member (12). The outer shell (0) defines a cavity for receiving the inner shell (I) and comprises a bottom wall (4B), a front wall (1) and two side walls (3R, 3L) upstanding from respective edges of the bottom wall. The inner shell (I) comprises a front wall (11), a rear wall (7) and two side walls (8R, 8L), the rear wall being connected to the bottom wall of the outer shell. The spring member (12) is hingedly connected by a first hinge (H 1) at a lower portion of the front wall (11) of the inner shell and is hingedly connected by a second hinge (H2) to the inner surface of the front wall of the outer shell. The inner shell (I) is hingedly connected to the outer shell (0) by a third hinge (H3) at the said bottom wall such that the inner shell moves with spring action between closed and open positions.

24 Claims, 16 Drawing Sheets

U.S. PATENT DOCUMENTS

| | | | | | |
|---|---|---|---|---|---|
| 2,944,555 | A | * | 7/1960 | Peel et al. | 206/273 |
| 3,272,321 | A | * | 9/1966 | Tamarin | 206/268 |
| 3,749,234 | A | * | 7/1973 | Gero | 206/273 |
| 3,877,573 | A | * | 4/1975 | Scott et al. | 206/236 |
| 4,588,081 | A | * | 5/1986 | Newsome et al. | 206/273 |
| 5,014,906 | A | * | 5/1991 | Gero | 206/273 |
| 5,174,492 | A | * | 12/1992 | Gero | 206/273 |
| 5,330,056 | A | * | 7/1994 | de la Rocha | 206/581 |
| 7,455,177 | B2 | * | 11/2008 | Serafini et al. | 206/268 |

FOREIGN PATENT DOCUMENTS

| | | |
|---|---|---|
| DE | 20107274 | 9/2001 |
| GB | 2254314 A | 10/1992 |

* cited by examiner r1 + r2 > d

Steps S7, S8, S9, S11

Steps S12, and S12'

PACKAGE FOR SMOKING ARTICLES AND THE LIKE

CROSS REFERENCE TO PRIOR APPLICATION

This application is a national stage filing (35 U.S.C. 371) of PCT/GB2005/0045 07, filed on Nov. 23, 2005, which claims priority to and benefit from Great Britain Patent Application No. 0426825.6, filed on Dec. 7, 2004, currently pending.

The present invention relates to a packet, blanks for making the packet and to a method of making the packet. Embodiments of the invention relate to packets for elongate cylindrical objects, for example smoking articles, but the invention is not limited to such packets or such objects.

German Utility Model 2802897 and its corresponding Australian document 766603 discloses a cigarette packet having an outer shell comprising a rectangular bottom wall from which upstand two side walls, a front wall and a rectangular top wall integral with the front wall and connected to the side walls. The outer shell forms a cavity which receives an inner shell. The inner shell has two side walls, and front and rear walls. The inner shell houses cigarettes the lower ends of which are supported by the bottom wall of the outer shell. The rear wall of the inner shell is integral with and hinged to the outer shell at an edge of the bottom wall of the outer shell. A connector connects the top of the front wall of the inner shell to the top of inner side of the front wall of the outer shell. The connector allows the inner shell to move from a first, closed, position in which it is received within the cavity and a second, open, position in which the inner shell projects from the cavity. In the first position the cigarettes are inaccessible. In the second position, the cigarettes are accessible. An aperture in the front wall of the outer shell allows a user to engage the front wall of the inner shell with their finger to push the inner shell from the first position to the second position. The packet is formed from one blank.

British Patent GB 2 254314 (Gero) discloses a packet having an inner shell and an outer shell hinged to the outer shell along one edge of a bottom wall of the outer shell. A snap lock member connects the top of the front wall of the inner shell to the top of inner side of the front wall of the outer shell. The snap lock member allows the inner shell to move from a first, closed, position in which it is received within the cavity and a second, open, position in which the inner shell projects from the cavity. In the first position the cigarettes are inaccessible. In the second position, the cigarettes are accessible. The snap lock member co-operates with the inner shell to provide a snap lock action in which the inner shell is firmly seated in the first and second positions but, when pushed, springs between those positions. In one example, the inner and outer shells are formed from one integral blank and the snap lock member is formed from a separate blank.

It is desired to provide a packet having inner and outer shells in which the inner shell moves with an improved spring action between closed and open positions and which allows improved access to the contents of the packet compared to the prior proposals discussed above.

According to one aspect of the present invention, there is provided a packet comprising:

an outer shell and an inner shell connected by a spring member;

the outer shell defining a cavity for receiving the inner shell and comprising a bottom wall having four sides, a front wall and two side walls upstanding from respective edges of the bottom wall;

the inner shell comprising a front wall, a rear wall and two side walls, the rear wall being connected to the bottom wall of the outer shell;

the spring member being hinged relative to the front wall of the inner shell by a first hinge at a lower portion of the front of the inner shell and being hingedly connected by a second hinge at an upper edge of the member to a position on the inner surface of the front wall of the outer shell spaced from the top of the outer shell;

the inner shell being hingedly connected to the outer shell by a third hinge at the said bottom wall;

the sum of a) the spacing of the first hinge from the second hinge and b) the spacing of the first hinge from the third hinge being greater than the spacing of the second hinge from the third hinge, whereby the inner shell springs between a first open position out of the outer shell in which contents of the inner shell are accessible and a closed position within the outer shell in which the said contents are inaccessible.

A connecting spring connecting the lower part of the front of the inner shell to a relative upper part of the front wall of the outer shell allows for greater access to the contents than a corresponding spring of the same length connecting the upper parts of the inner and outer shells. The spring action is also improved compared especially to the prior proposal of Gero described above.

In an embodiment of the invention, the first hinge is, in the closed position of the packet, spaced from the third hinge by a distance which is small compared to the distance of the third hinge from the top of the pack. The spacing of the first hinge from the third hinge may be small compared to the spacing of the second hinge from the third hinge. The first hinge may be at a lower portion of the front wall of the inner shell. The front wall may be separate from the hinge.

In an embodiment of the packet is formed of two blanks. In the embodiment the spring member and the front wall of the inner shell are formed from one blank, and the other walls of the outer shell and of the inner shell are formed from another blank. However, embodiments may comprise one, two or three blanks as discussed hereinafter.

In an embodiment, the front wall of the outer shell has an aperture positioned so a user can engage the front wall of the inner shell with the user's finger to move the inner shell from its closed position to its open position and wherein the upper edge of the spring member is intermediate the aperture and the bottom wall. That allows the packet to be opened with one hand.

Another embodiment comprises recesses in the respective side walls of the outer shell to allow the user to grasp the side walls of the inner shell to move it out of the outer shell. Alternatively, a recess may be provided in the top wall of the outer shell. The length of the spring member may be such that in the open position the inner shell is at an angle in the range of about 5 to about 180 degrees to the outer shell. The length of the spring member may be such that in the open position the inner shell is at an angle in the range 40 to 90 degrees, or 20 to 40 degrees to the outer shell. Opening the packet to such angles allows convenient access to the contents. The angle of opening is dependent partly on the number of rows of contents in the packet. A packet having two rows of contents may open to a greater angle than a packet with three rows of contents, for the same length of spring member.

In preferred embodiments of the packet, the outer shell has a top wall which fits snugly to the top of the inner shell in the closed position of the packet. The top of the inner shell may be defined by a top wall. The spring member is arranged to lift the outer shell over the inner shell when moved by the spring member from its open position to its closed position to enable the said top wall of the outer shell to fit over the top of the inner shell. To allow the outer shell to be lifted over the inner shell by the spring member, the side walls of the inner shell are slightly shorter than the rear wall of the inner shell by a small amount X to provide a rear wall portion of length X adjacent to the third hinge. X is of a length such that, in use, the spring member moves the outer shell bottom wall towards the side walls of the inner shell, closing the gap therebetween. Thus the outer shell top wall moves over the top of the side walls of the inner shell and over the contents (which may be a bundle of cigarettes for example) without fouling against the same.

The gap provided by length X between the bottom wall of the outer shell and the side walls of the inner shell allows the bottom wall or the rear wall of the inner shell to distort adjacent the third hinge, thus preventing tearing of the bottom or rear walls. The spring member creates stress in the packet. The magnitude of the stress may be such as to distort the packet. Thus one embodiment comprises reinforcement of the said lower portion of the front wall of the inner shell at the said first hinge. Alternatively the packet may be constructed of material (e.g. cardboard) sufficiently strong to withstand the stress without reinforcement.

The third hinge may be at the edge of the bottom wall from which the front and sidewalls do not upstand. Alternatively, the third hinge may be parallel to, but intermediate, the edge of the bottom wall from which the front wall upstands and the edge opposite thereto. For example the third hinge may be along the centre of the bottom wall.

Positioning the third hinge at the said edge of the bottom wall provides better spring action than positioning the third hinge along the centre of the bottom wall. Also the packet is considered to be visually more attractive.

Positioning the hinge along the centre of the bottom wall allows the outer shell to clear the inner shell without taking other measures as described above.

In a further embodiment of the invention the said first hinge is between the said spring member and a further member hingedly connected at a fourth hinge to the front wall of the inner shell.

The invention also provides blanks corresponding to the packets described herein and claimed in the claims. The invention also provides methods of making the packets the packets described herein and claimed in the claims The invention also provides a packet according to the invention containing smoking articles, for example cigarettes, cigarillos or cigars.

For a better understanding of the present invention, and to show how the same may be carried into effect, reference will now be made by way of example to the accompanying drawings in which:

FIG. 1A is a schematic perspective drawing of a first example of a packet in accordance with the present invention;

FIGS. 1B, 1C, 1D and 1E illustrate the principles and effect of the action of a spring member of the packet of FIG. 1;

FIG. 2 is a side view of the packet of FIG. 1A;

FIGS. 3 and 4 are plans of blanks used to form the packet of FIG. 1A;

FIG. 5 shows plans of blanks used to form a modified example of the packet of FIG. 1A;

FIGS. 6A to 6F show stages in the manufacture of the first example from the blanks of FIGS. 3 and 4;

FIG. 7 is a schematic perspective drawing of a third example of a packet in accordance with the present invention;

FIGS. 8 and 9 are plans of blanks used to form the packet of FIG. 7;

FIG. 10 is a side view of the blank of FIG. 8 folded as in use in the packet of FIG. 7; and FIG. 11 shows a modification of the blank B2 of FIG. 4;

FIGS. 12A and 12B show a modification of the packet of FIGS. 7 to 11 which provides a fourth example of a packet in accordance with the invention; and FIG. 13 is a plan view of a modification of the blank of FIGS. 3, 5 or 8.

DESCRIPTION OF THE DRAWINGS

First Example

Figure 1A:
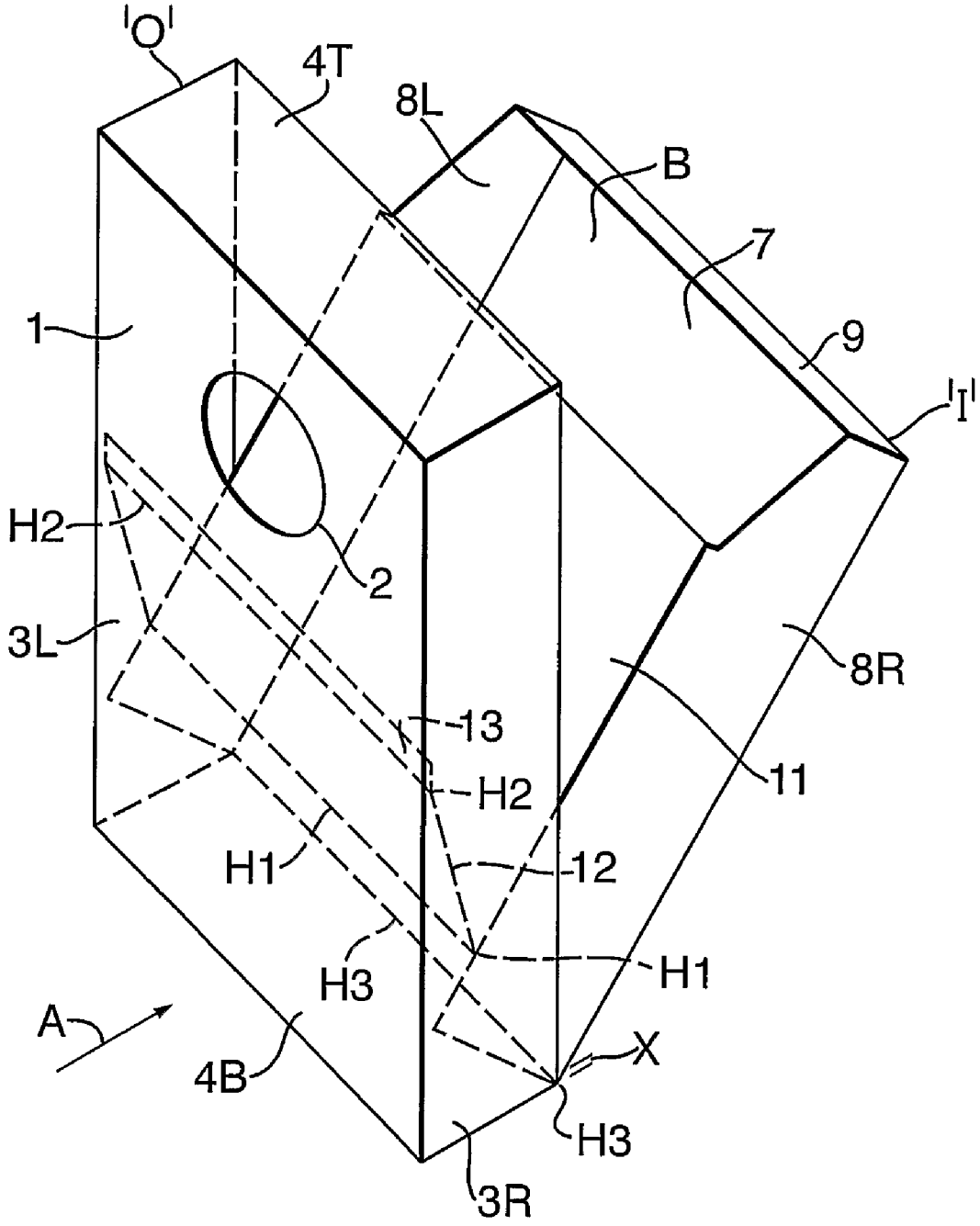
Referring to FIGS. 1A and 2, a first example of a packet in accordance with the present invention is shown. The packet of FIG. 1A is intended for containing cigarettes.

In the following description and in the claims, the packet is described using the following terms: top, bottom, front, rear, side, right, left, upper and lower. Those terms refer to the packet in the orientation shown in FIG. 1A in which the packet will normally be used and viewing the packet in the direction of the arrow A towards the main (front) wall 1 of the outer shell O of the packet.

The packet comprises an outer shell O and an inner shell I. The outer shell defines a cavity which contains the inner shell when the packet is closed. Cigarettes are contained in the inner shell. The inner and outer shells are connected by a spring member 12 so arranged that the inner shell is stably held in its closed position within the outer shell and is held stably in its open position out of the outer shell but, when moved, springs between the open and closed positions under the spring action of the member 12.

The outer shell comprises a front wall 1 having an aperture 2, left and right side walls 3L and 3R, a bottom wall 4B and a top wall 4T. The side and front wall upstand from respective ones of three of the edges of the bottom wall. The fourth edge is connected to the inner shell.

The inner shell comprises a front wall 11, left and right side walls 8L and 8R, a top wall 9 and a rear wall 7. The rear wall of inner shell is hinged to the outer shell at a hinge H3 along the fourth edge of the bottom wall 4B of the outer shell.

The spring member 12 is hingedly connected to the inner surface of the front wall 1 of the outer shell at a hinge H2. Hinge H2 is just below the aperture 2. The spring member 12 is hingedly connected to the lower part of the front wall 11 of the inner shell at a hinge H1 above hinge H3.

Figure 1B:
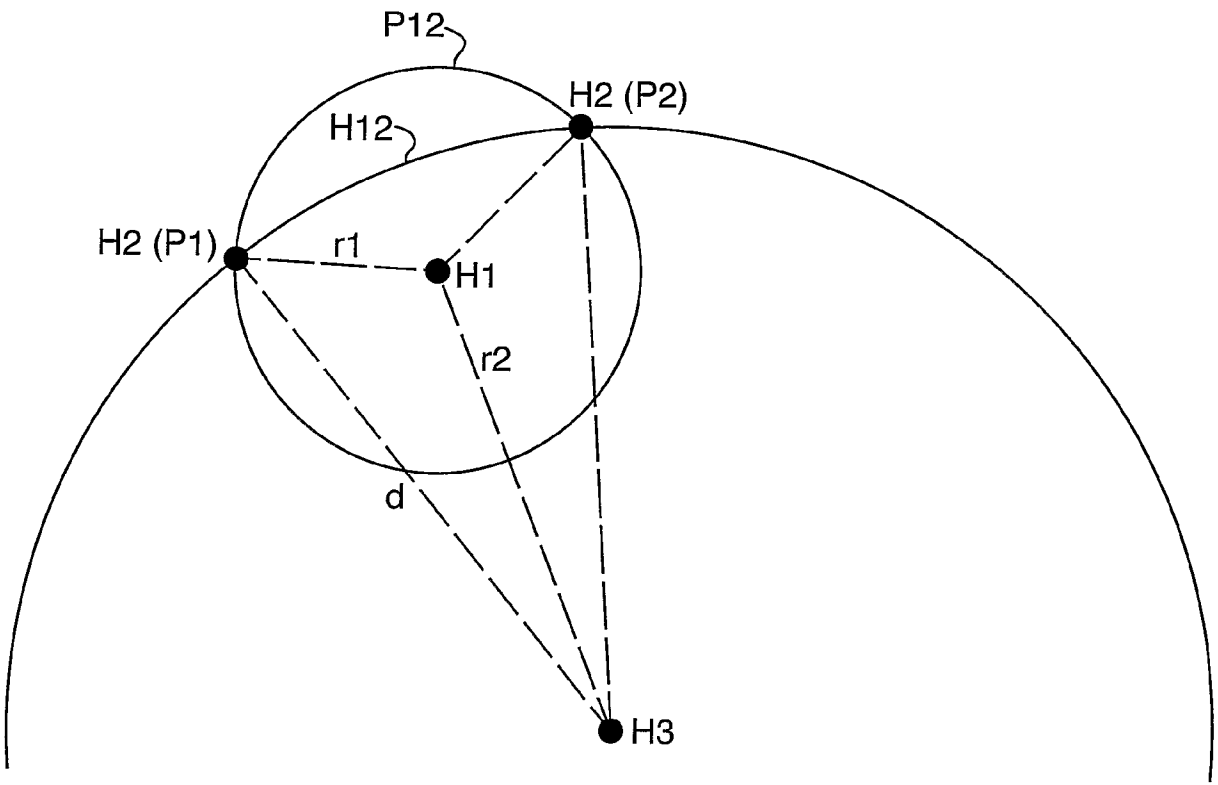

Referring to FIG. 1B: the spacing of the hinge H2 from hinge H1 is r1: the spacing of the hinge H1 from hinge H3 is r2; the spacing of the hinge H2 from hinge H3 is d; and r1+r2>d. In the closed and open positions of the inner shell the hinges are arranged in positions P1 and P2. In between positions P1 and P2 the spring member 12 is stressed which causes the spring to firstly oppose movement from the starting one of the stable positions P1 or P2 to an intermediate position but eventually to spring from the intermediate position to the other stable position. By the way of further explanation, assume that the hinge H3 is fixed and hinge H1 is at a fixed distance, r2, from H3. For hinge H2 to move from position P1 to P2 it must rotate about H1 with radius r1. Thus if the spring member were rigid, H2 would follow arc P12, but in fact it is forced to follow arc H12 of radius d about H3. The difference between P12 and H12 is the amount of deformation of spring 12 which creates the spring action.

Figure 1C:
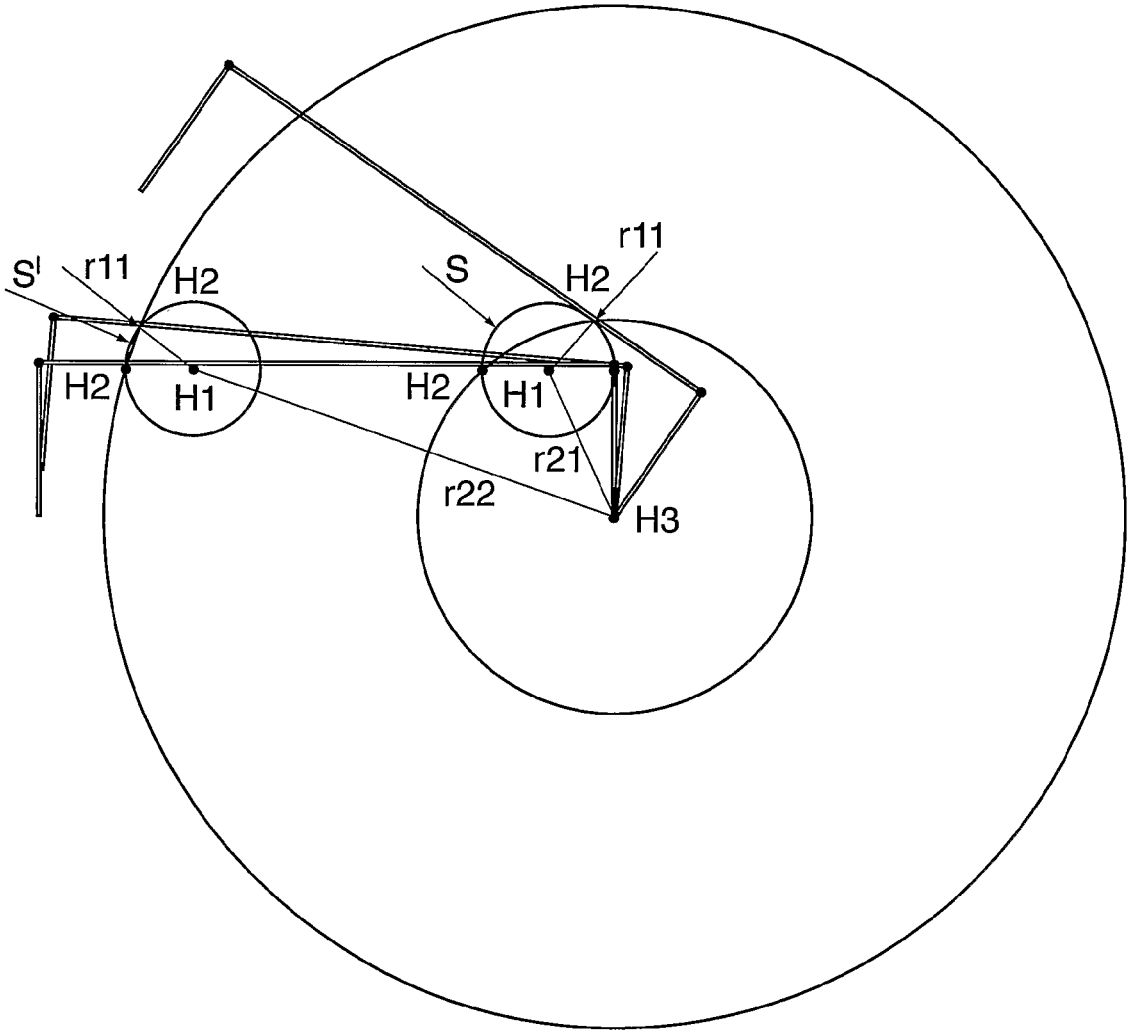

As shown in FIG. 1A, the hinge H1 is at the lower portion of the front wall 11 of the inner shell. FIG. 1C demonstrates the effect on the distortion of the spring member of the location of hinge H1 from hinge H3. As shown in FIG. 1C, for the radius r11 from H1 to H2, placing H1 nearer to H3 increases the distortion S of the spring member. That can be seen by comparing the distortion S when H1 is at radius r21 to the lesser distortion S' when H1 is at radius r22 relative to H3. Thus the embodiments of the present invention provide improved spring action compared to that of Gero's proposal in GB 2254314.

Figure 1D:
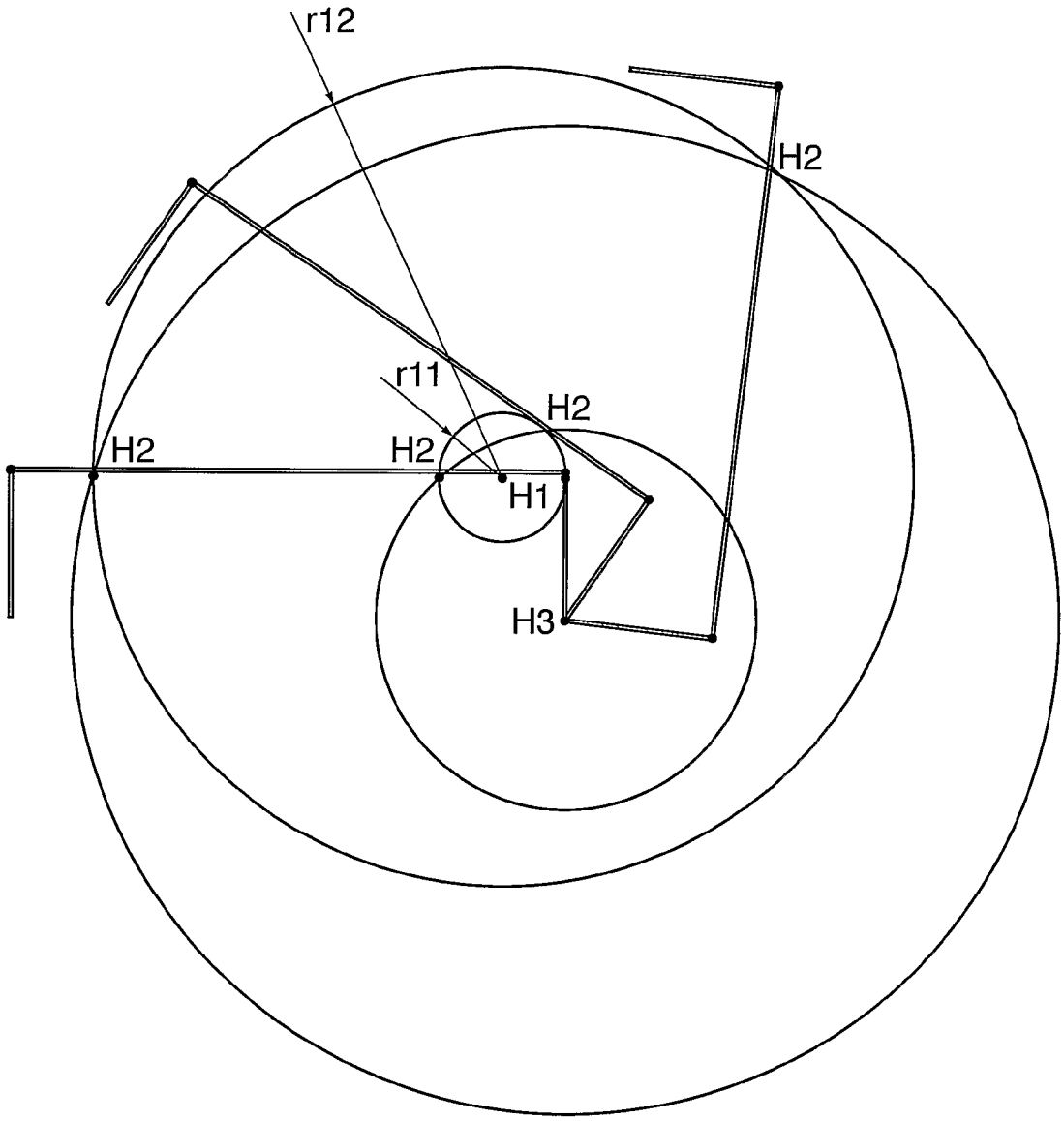

FIG. 1D demonstrates the effect of the distance of hinge H2 from H1, or in other words the length of the spring member 12, for constant distance r21 of the hinge H1 from hinge H3. The Figure shows a) hinge H2 is spaced from H1 by a small radius r11; and b) hinge H2 spaced from hinge H1 by a large radius r12. Firstly, the angle of opening of the shells is greatly increased with large radius r12 (relative to r11). Secondly, the deformation of the spring as a percentage of its length is reduced but the snap action is still good. Thus the embodiments of the present invention provide improved access compared to that of Gero's proposal whilst maintaining improved snap action.

In its closed position the inner shell is contained within the outer shell with its front wall 11 abutting the front wall 1 of the outer shell and covering the aperture 2. The aperture 2 allows a user to grip the side walls 3L and 3R of the outer shell with for example their thumb and second finger and to push the front wall 11 of the inner shell with their first (index) finger to cause the inner shell to spring open as described above. Thus the packet can be opened with one hand.

In this example, three rows of cigarettes are contained in a bundle wrapped in protective wrapping as well known in the art. In this example, the bundle is contained in the inner shell supported at the bottom by the bottom wall of the outer shell. Access to the cigarettes is, in the open position of the inner shell, via an opening B defined by the front wall 11, the top wall 9 and the side walls 8 of the inner shell. The opening faces generally inwards towards the outer shell O, so that the bundle is protected by the inner and outer shells in the closed position thereof. In this example the inner shell opens to an angle, relative to the outer shell, in the range 20° to 40°, preferably 25° to 35°, for example about 30° to enable the user access to the cigarettes. However other examples can open in the range from about 5 to 180 degrees.

Figure 1E:
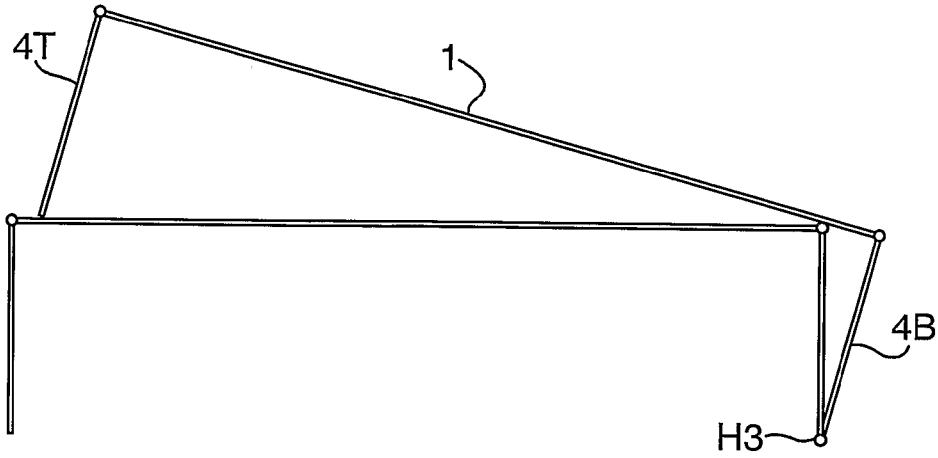

In the example shown, the top wall 9 of the inner shell I fits snugly under the top wall of the outer shell in its closed position, the spacing of the top wall 9 of the inner shell from the bottom wall 4B of the outer shell being nearly equal to the spacing of the top wall 4T of the outer shell from the bottom wall 4B. Furthermore, the spacing of top wall 9 from bottom wall 4B is nearly equal to the height of the bundle of cigarettes so that the bundle is held firmly with no slack within the packet. As a result, the leading edge of the top wall of the outer shell in theory would not clear the top of a frill bundle of cigarettes contained in the inner shell as the inner shell moves from its open position to its closed position as illustrated in FIG. 1E. It has been shown that, with suitable dimensions of the spring 12, the spring tends to lift the outer shell over the top wall of the inner shell to clear the bundle when the inner shell moves to its closed position. That is achieved by for example making the side walls 8R and 8L of the inner shell shorter by a small amount X (see FIG. 1A) than the rear wall 7 of the inner shell. The small amount X allows the rear wall 7 to distort adjacent the rear wall) in the region of the hinge H3 sufficient to allow the spring 12 to lift the outer shell O over the top wall 9 of the inner shell. Other ways of allowing sufficient distortion of the inner and/or outer shell adjacent hinge H3 are described hereinafter.

Figure 2:
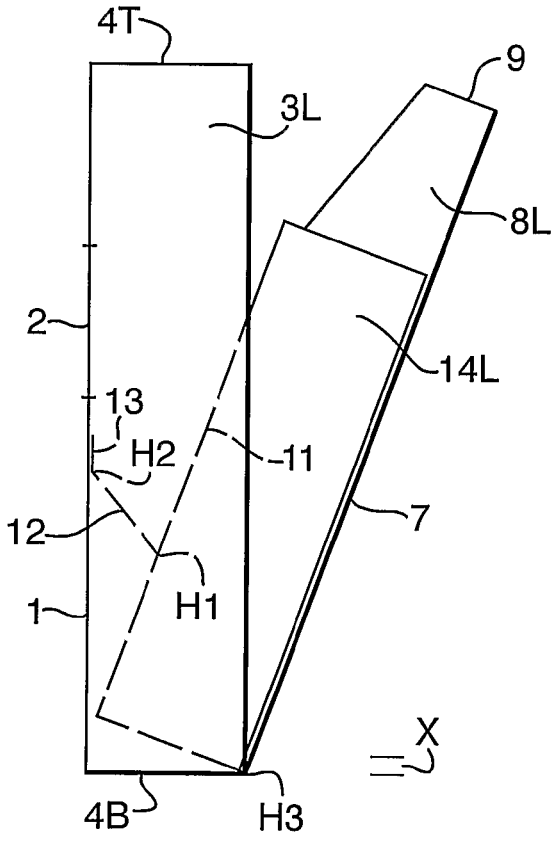
Figure 4:
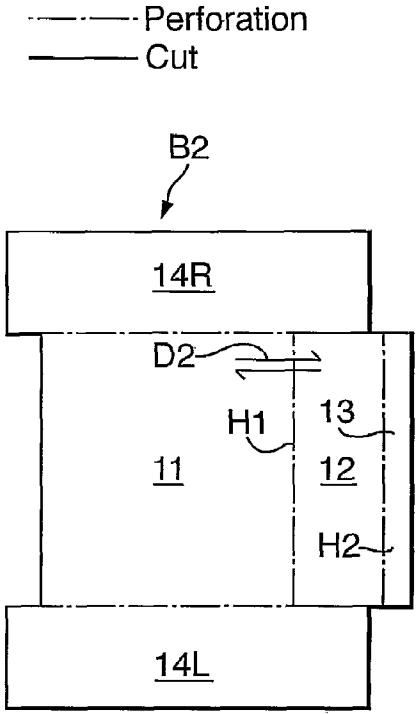
Figure 3:
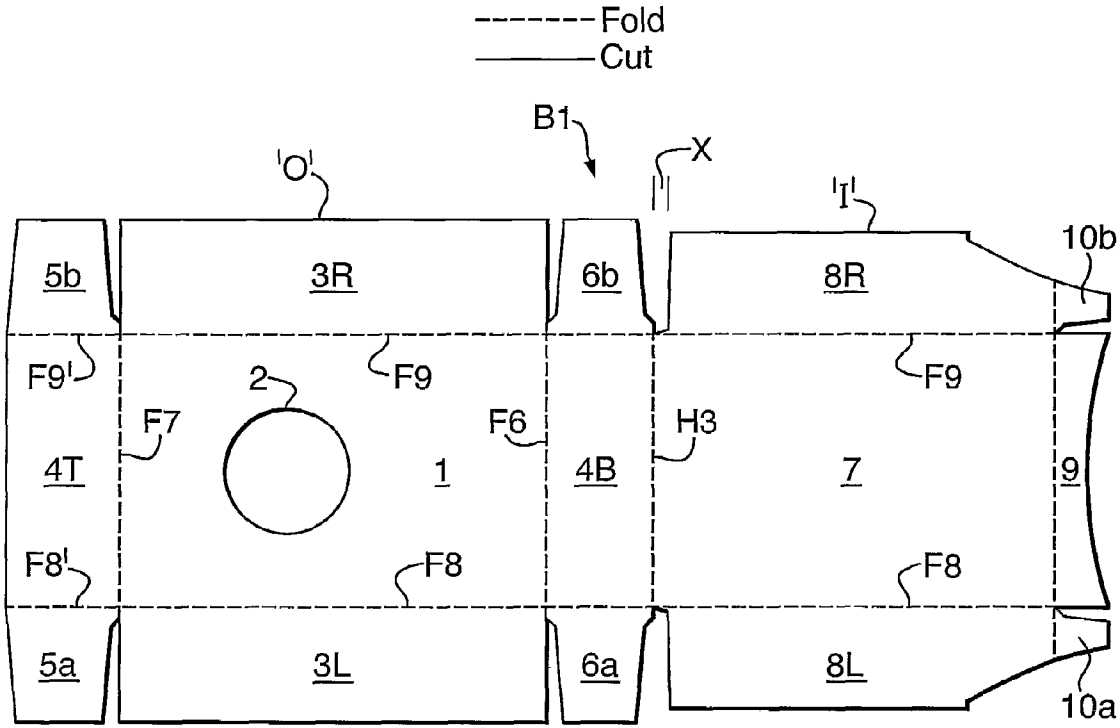

The packet of FIGS. 1 and 2 is made of cardboard as well known in the art. Whilst the packet of FIG. 1A could be made with one, two or three blanks, in this example it is made from two blanks B1 and B2 as shown in FIGS. 3 and 4. FIGS. 3 and 4 use the same references as FIGS. 1 and 2. Continuous lines indicate cuts, dashed lines indicate fold lines (which may be creased or perforated) and dash-dot lines indicate perforated lines. The currently preferred orientation of the grain or fibres of the board of blank B2 comprising the spring 12 is as shown by the double arrow. Referring to FIG. 3, blank B1 comprises the front wall 1 containing the aperture 2, integral with side walls 3R and 3L, top wall 4T, and bottom wall 4B of the outer shell O. The top wall 4T is integral with side tabs 5*a* and 5*b* and bottom wall is integral with side tabs 6*a* and 6*b*. The side and top and bottom walls are integral with the front wall 1 via fold lines. The tabs are integral with the top and bottom walls via fold lines.

The blank B1 also comprises the rear wall 7 and the side walls 8R and 8L and the top wall 9 of the inner shell I. The side walls 8R and 8L and the top wall 9 of the inner shell are integral with the rear wall 7 via fold lines. The rear wall 7 is integral with the bottom wall 4B of the outer shell via a fold line. The side walls 8R and 8L are integral with tabs 10*a* and 10*b* via fold lines.

The blank B2 comprises the front wall 11 of the inner shell, integral with the spring member 12 via hinge H1. The spring member is integral with, and hinged at hinge H2 to, a flap 13. Flaps 14R and 14L are integral with side edges of the front wall 11. Flaps 14R and 14L are the same length or shorter than the corresponding portions of flaps 8R and 8L; to allow a zone X of distortion of the rear wall adjacent hinge H3; and to allow the spring 12 to lift the outer shell O over the top wall of the inner shell I, the flaps 14R and 14L should not exceed the length of flaps 8R and 8L, more specifically should not overlap the edges of flaps 8R and 8L adjacent bottom wall 4B.

In a preferred example, the blank B2 is cut during assembly of the packet from a reel of cardboard. It is preferable that one end of the blank matches the other end so successive blanks can be cut from the reel with no waste.

Blank B1 may be provided precut before assembly begins.

One example of a process of making the packet of FIG. 1A using blanks B1 and B2 is as follows, referring to FIGS. 6A to 6F. It will be appreciated that the packet may be made in other ways.

A bundle of cigarettes is made including its protective wrapping; step S1. Also, blank B2 is cut from a reel; step S2. The right and left flaps 14R and 14L of the blank B2 are folded through 90°; step S3 and FIG. 6B. Spring member 12 and its flap 13 are together folded through 180° about hinge H1; step S4 and FIG. 6C. The bundle is then put into the folded blank B2: step S5. For clarity the FIGS. 6C to 6F do not show the bundle.

Figure 6A:
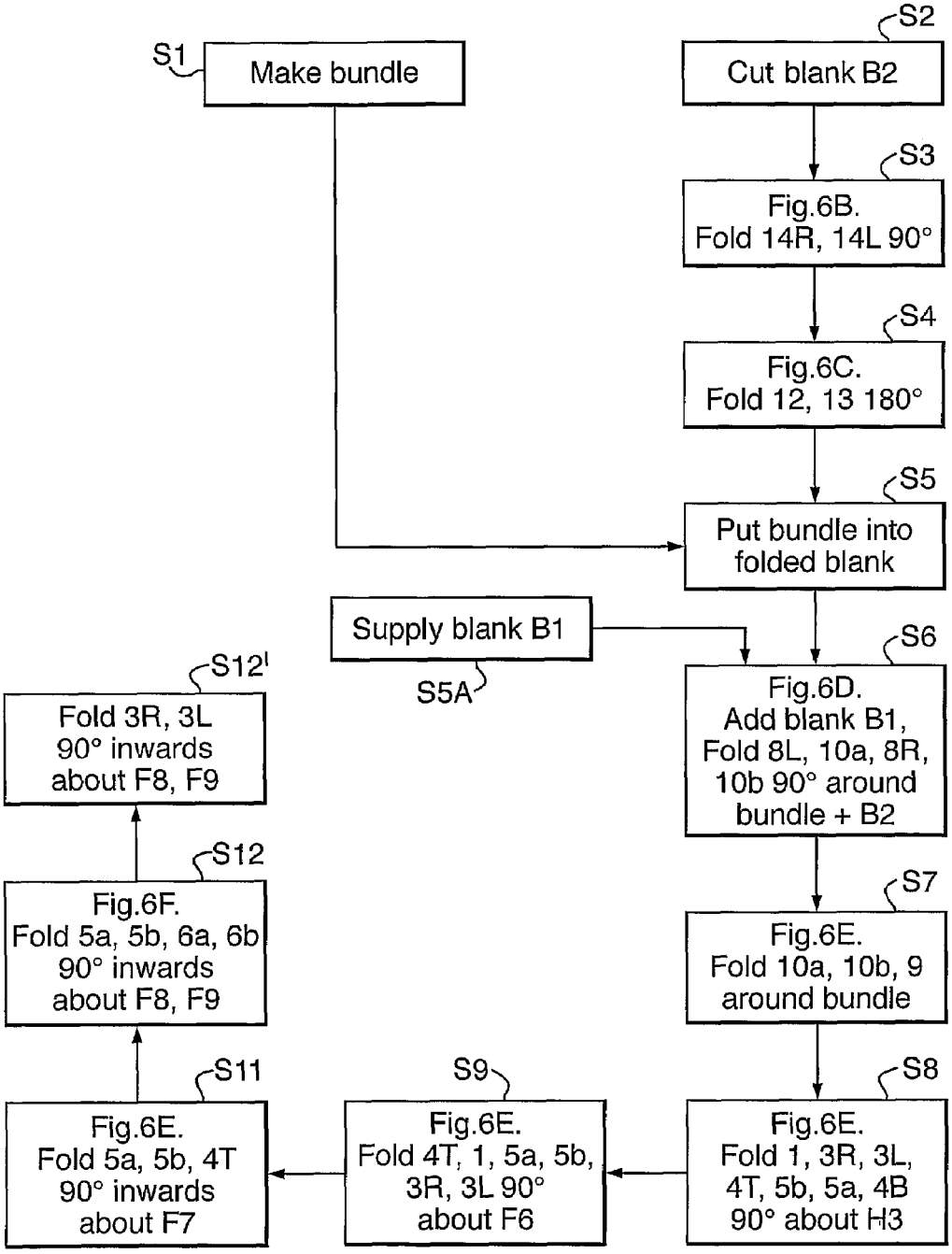
Figure 6D:
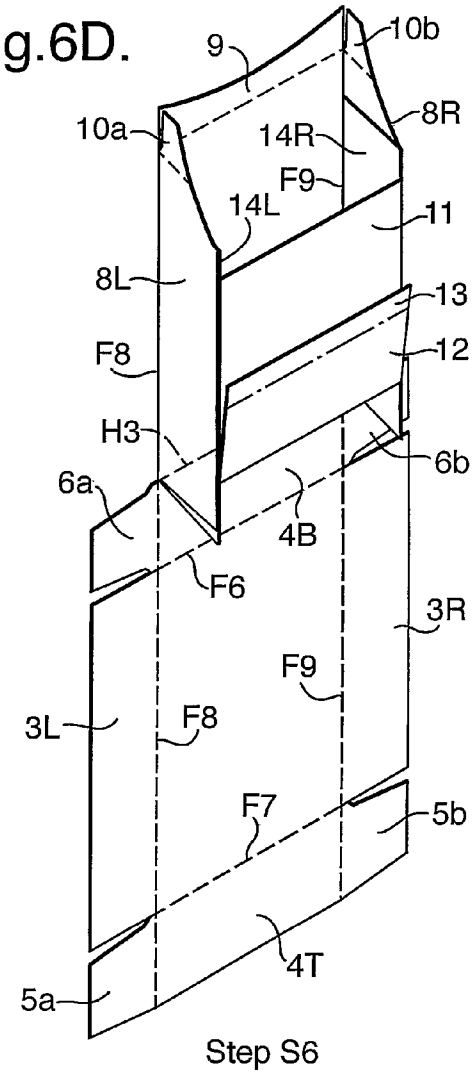
Figure 6C:
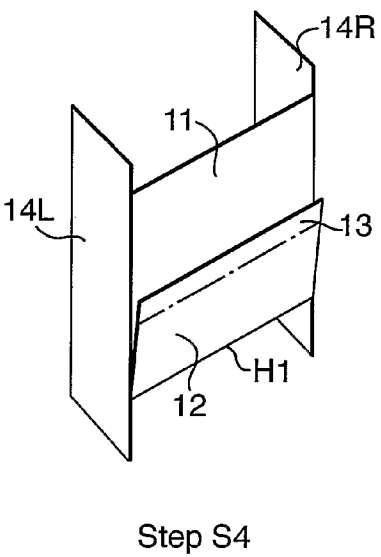
Figure 6B:
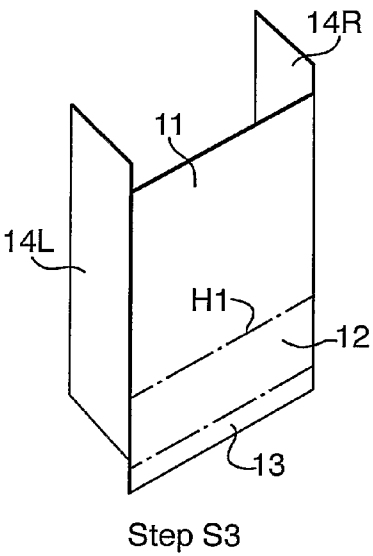

The blank B1 is supplied from a stack of such precut blanks. The hinge line H3 is placed adjacent to the bottom edges of the flaps 14L and 14R of the blank B2 with the wall 1 and its attached flaps and tabs extending beyond the bottom edges of the flaps 14R and L as shown in FIG. 6D. The flaps 8L and 8R are folded through 90° about fold lines F8 and F9 around the sides of the bundle; step S6. Flaps 8L and R are glued to flaps 14 at this stage.

Next in step S7, the tabs 10*a* and 10*b* are folded through 90° and the top wall 9 of the inner shell is folded through 90° onto the tabs to form the top wall of the inner shell. The flap 9 is glued to tabs 10 at this stage.

Figure 6E:
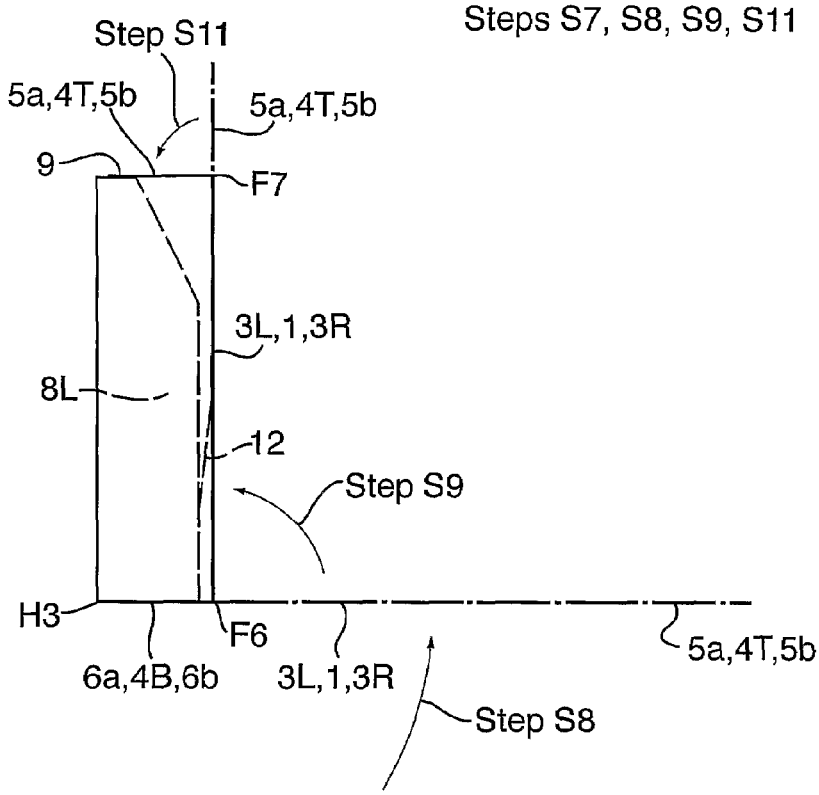

Next the front wall 1 of the outer shell and its attached flaps 3L, 3R, 4T, 4B and its tabs 5*a*, 5*b*, 6*a* and 6*b* are folded about hinge line H3 through 90°; step S8 and FIG. 6E. Thus the bottom wall 4B is correctly positioned. Then, wall 1 and its flaps 3L, 3R, 4T and tabs 5*a*, and 5*b* are folded about fold line F6 through 90°; step S9 and FIG. 6E. This results in the spring member 12 being trapped between the front walls 1 and 11 of the inner and outer shells. The spring member flap 13 is glued to wall 1.

In step S11, the top wall 4T of the outer shell and its tabs 5*a* and 5*b* are folded through 90° about fold line F7 to position the top wall correctly. See FIG. 6E.

Figure 6F:
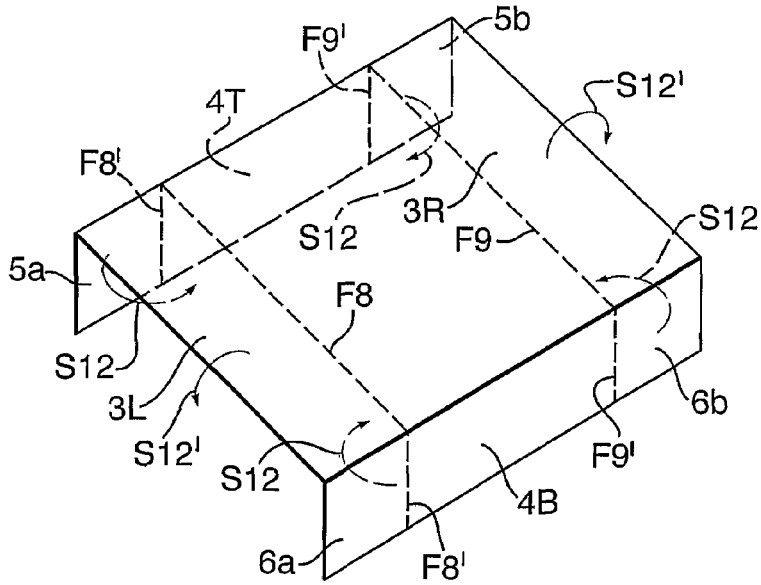

Referring to FIG. 6F, in step S12, the tabs 5*a* and 5*b*, 6*a* and 6*b* are folded through 90° about fold lines F8' and F9' and in step S12' the side flaps 3L and 3R are folded through 90° about fold lines F8 and F9 onto the tabs 5*a*,5*b* 6*a*, 6*b*. The flaps 3 are glued to tabs 5 and 6 at this stage.

Glue is applied to the flaps and tabs at appropriate stages of the process, as well known in the art. For example glue may be applied to at least some parts of the blanks at the start of the process. Glue may be applied to some parts during the process.

Second Example

In the first example the inner shell I is hinged to the outer shell O by means of the bottom edge of its rear wall hinged to the edge of the bottom wall 4B of the outer shell. This second example differs from the first example in that the outer shell is hinged to the inner shell at a hinge H3' parallel to the front wall 1 of the outer shell and the rear wall 7 of the inner shells and which is on the bottom wall 4B intermediate the edges thereof.

Figure 5:
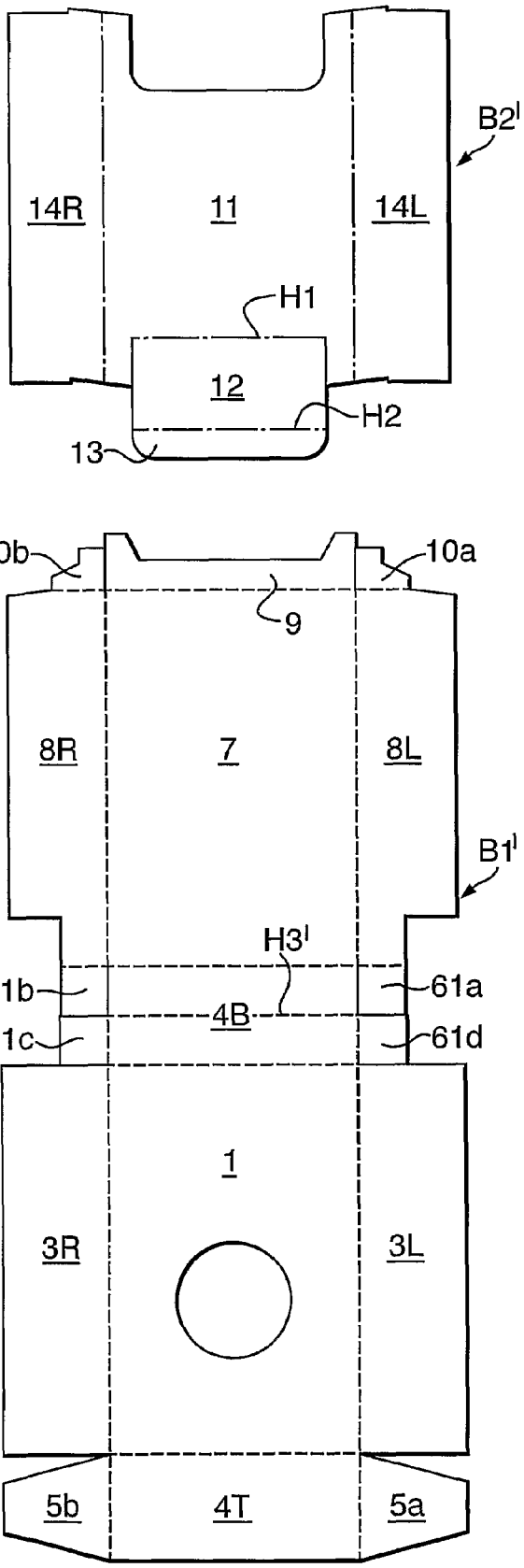

Referring to FIG. 5, the blank B1' differs from the blank B1 of FIG. 3 only as follows. The bottom wall 4B has a hinge H3' along the centre thereof parallel to the bottom edges of the rear wall 7 of the inner shell and of the front wall 1 of the outer shell. The side tabs 6*a* and 6*b* of FIG. 3 are replaced by tabs 61*a* to *d* of which the right hand side tabs 61*b* and *c* are separated by a cut collinear with the hinge H3'. The left hand side tabs 61*a* and *d* are separated likewise. Tabs 61*c* and 61*d* are connected by folds to the side edges of the bottom wall 4B and separated from the side walls 3R and 3L by cuts. The tabs 61*b* and 61*a* are connected to the side walls 8R and 8L by folds and separated from the bottom wall 4B by cuts. In this embodiment, when the packet is erected, the bundle will be supported by tabs 61*a* and 61*b*.

Blank B2' shown in FIG. 5 differs in minor details from blank B2 of FIG. 4, but in essence is the same.

Third Example

The third example is shown in FIGS. 7 to 11.

FIGS. 7 to 10 use the same references as are used in FIGS. 1 to 5 for like parts. The construction and operation of the third example is generally similar to that of the first example and so it will not be described in detail: instead the differences from the first example will be described. In this example the cigarettes are in two rows not three as in the first example. However they could be in three rows.

The third example differs from the first and second examples primarily in that the spring member 12 is long enough to allow the inner shell to open to more than 40°, in this example to just less than 90° relative to the outer shell. The front wall 1 of the outer shell has no aperture 2: instead the side walls 3L and 3R have recesses Rr and R1 to allow the user to grip the side walls 8R and 8L of the inner shell to open the packet. Alternatively, a recess may be provided in the top wall 4T.

Figure 7:
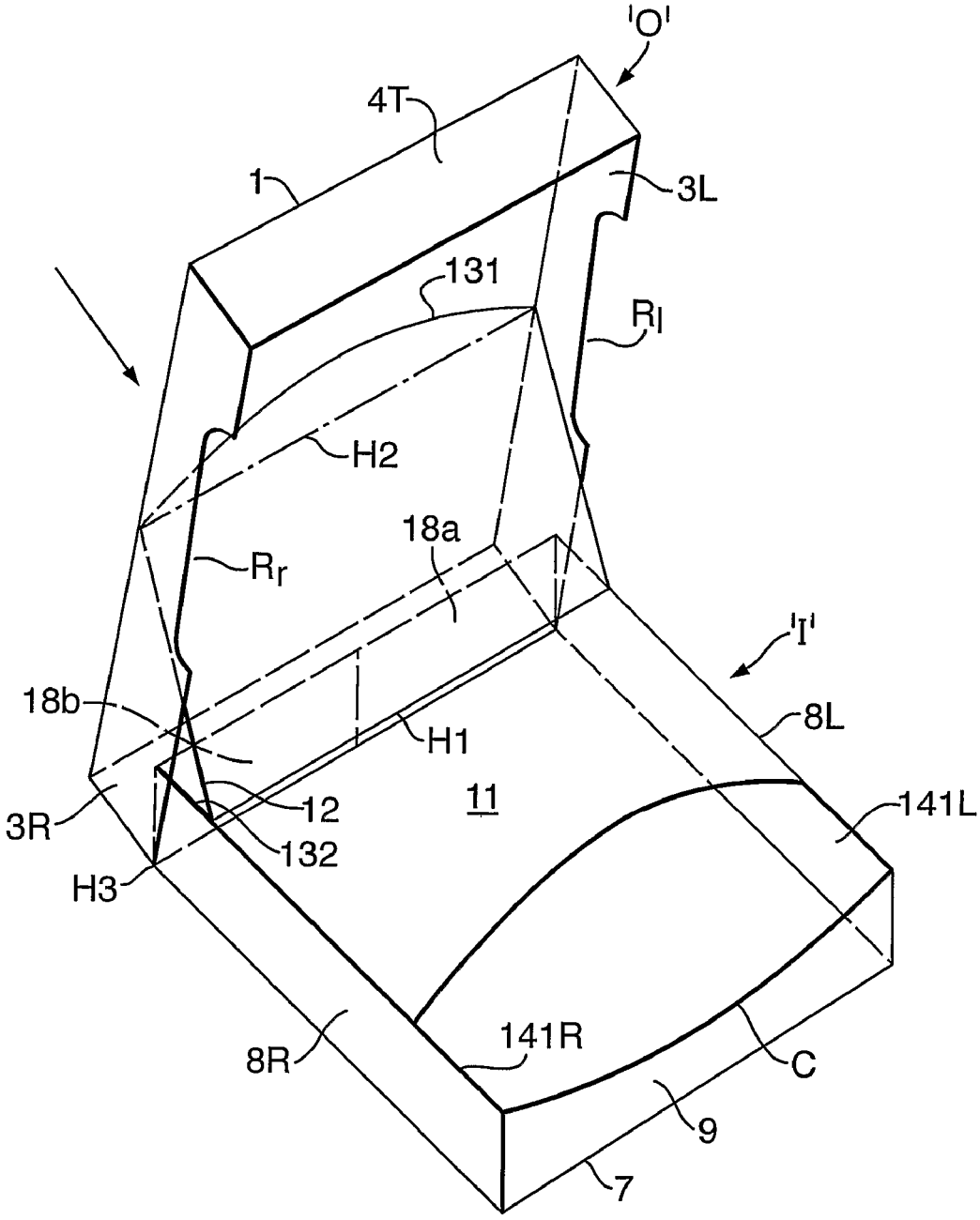

The example of FIG. 7 assumes that the packet is made of board of such weight that the size of the spring member 12 requires reinforcement of the area of the front wall 11 at which the inner shell is hingedly connected by the hinge H1 to the spring member 12; otherwise it has been found that the wall 11 distorts. Such distortion may damage the cigarettes. If heavier board is used such reinforcement may not be necessary.

Figure 9:
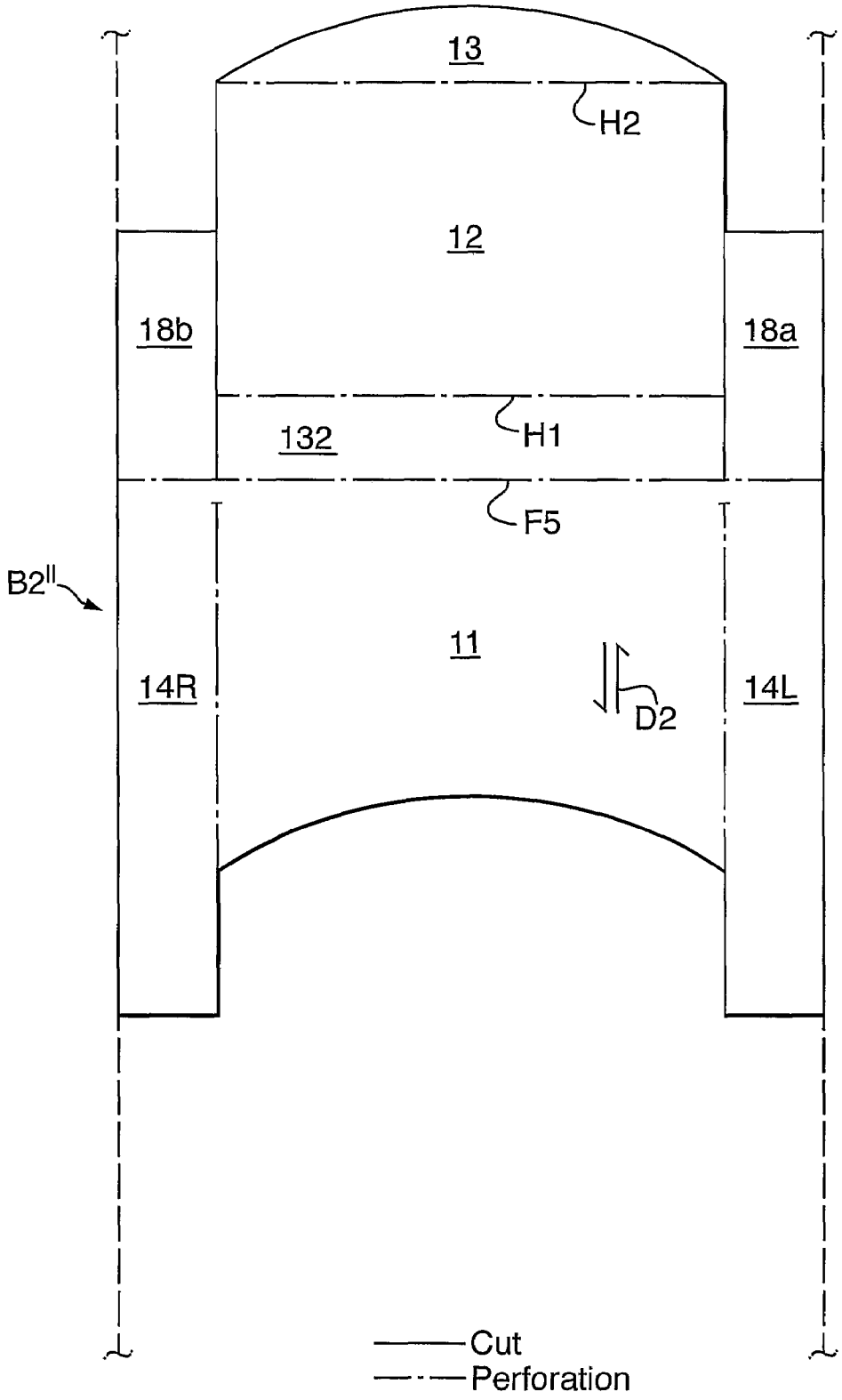

The reinforcement is provided, as best shown in FIG. 9, by a reinforcement member 132 glued (g) to the front wall 11 of the inner shell at a position adjoining the hinge H1. In this example the reinforcement member 132 is between the hinge H1 and the lower edge of the front wall 11.

As shown in FIGS. 7 and 9 the reinforcement member 132 is provided by folding back a portion 132 (which is the reinforcement member) of the blank B2" along a fold line F5 and gluing the portion 132 to the wall 11.

Figure 10:
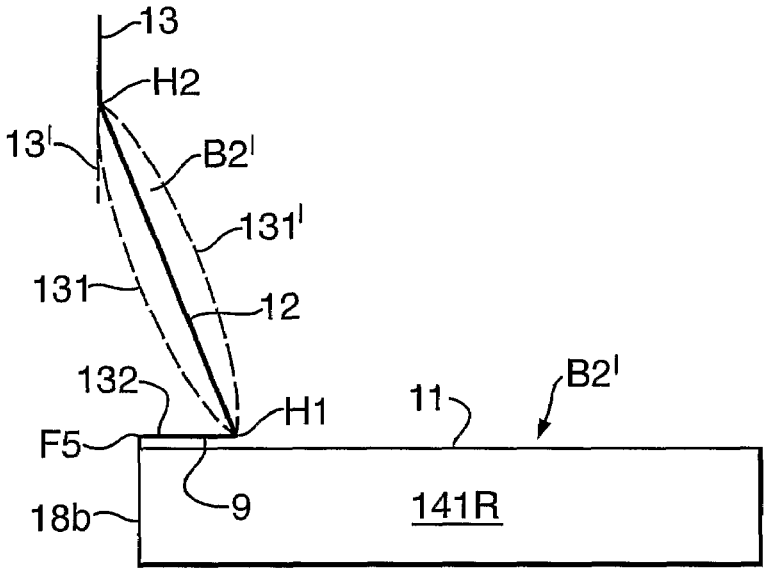

As shown in FIGS. 7 and 10, in one version of the third example the flap 13, which is glued to the inner surface of the front wall 1 of the outer shell 'O' extends from the hinge H2 towards the top wall 4T. It has been found that the spring member 12 when in the open position sometimes bows concavely, i.e. in the form indicated at 131 in FIG. 10, locking the packet in the open position.

In another version of the third example, as shown in FIG. 10 at 13', the flap 13 extends from the hinge H2 away from the top wall. It has been found that the spring member 12 then bows convexly as shown by 131' more reliably reducing the incidence of locking in the open position.

Such a flap 13' extending away from the top wall may be used in the first and second examples.

Blanks of the Third Example

The third example of the packet comprises two blanks: B1" (FIG. 8); and B2 (FIG. 9) corresponding to blanks B1 and B2 of FIGS. 3 and 4.

Figure 8:
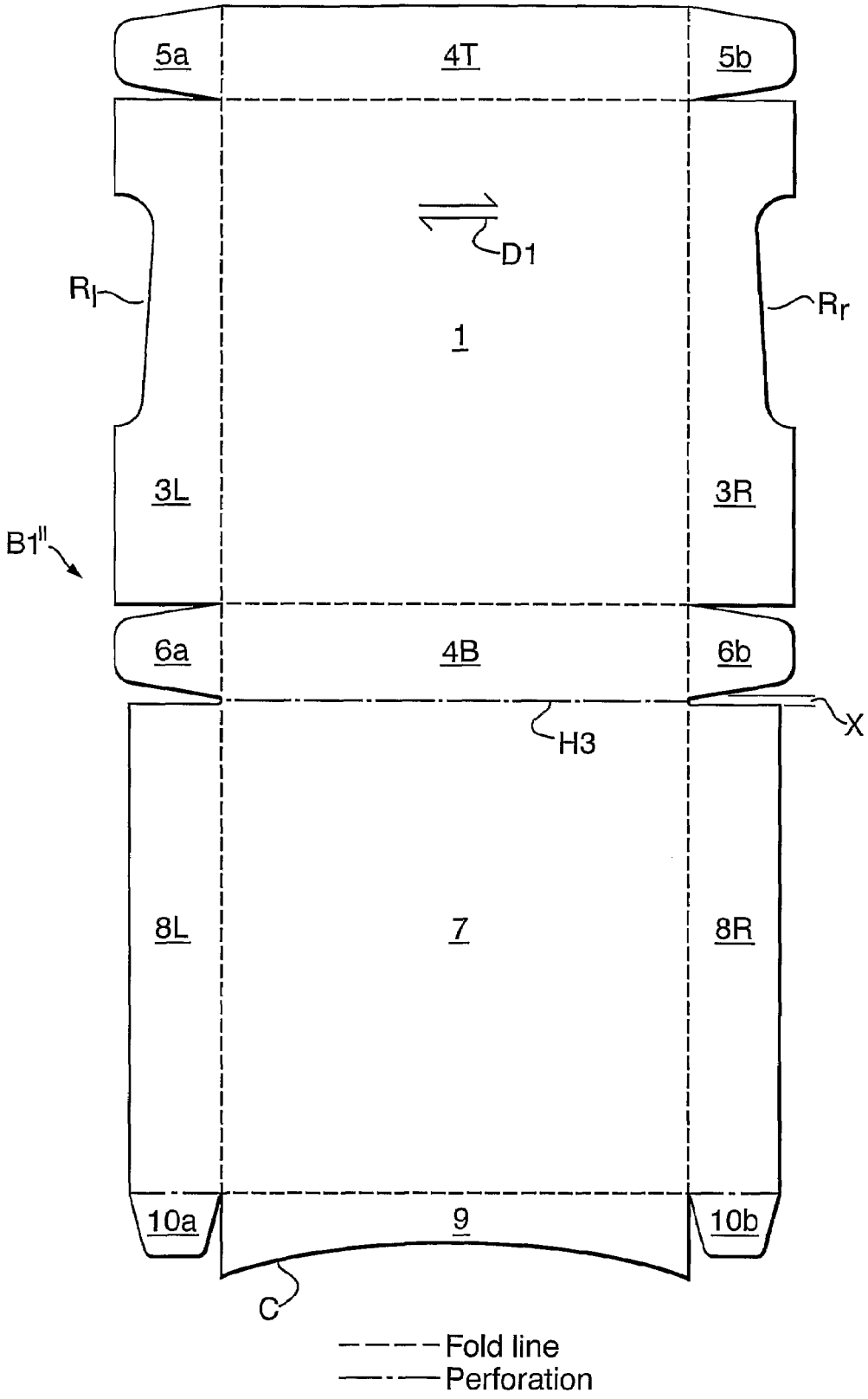

Referring to FIG. 8, the blank B1" differs (apart from overall dimensions) from blank B1 only in that it has recesses Rr and R1 in the side walls 3R and 3L for opening the packet instead of the aperture 2.

Referring to FIG. 9, the blank B2", corresponding to blank B2, differs from blank B2 as follows.

In blank B2" the front wall 11 is integral with the member 132, being joined to it via fold line F5. The member 132 is integral with the spring member 12 being joined to it via hinge H1. The member 12 is integral with a flap 13 being joined to it via hinge H2. The front wall 11 has side flaps 14R and 14L. The flaps are integral with additional flaps 18*a* and *b* which are joined to the flaps 14R and L at the ends thereof adjacent to, and parallel to, the fold line F5. Flaps 18*a* and *b* are separated from the members 12 and 132 by cuts. The fold lines between the flaps 14R and L and the wall 11 are preferably weakened by for example perforations. The fold line F5 between the member 132 and the wall 11 is preferably weakened by for example perforations. The hinges H1 and H2 are preferably weakened by for example perforations.

The blank B2" is preferably cut from a reel like blank B2. The flaps 18*a* and *b* are useful for positioning the blank B2" relative to a bundle of cigarettes and positioning the bundle and blank relative to the blank B1" during assembly of a packet of cigarettes.

Fourth Example

FIG. 12

Figure 12A:
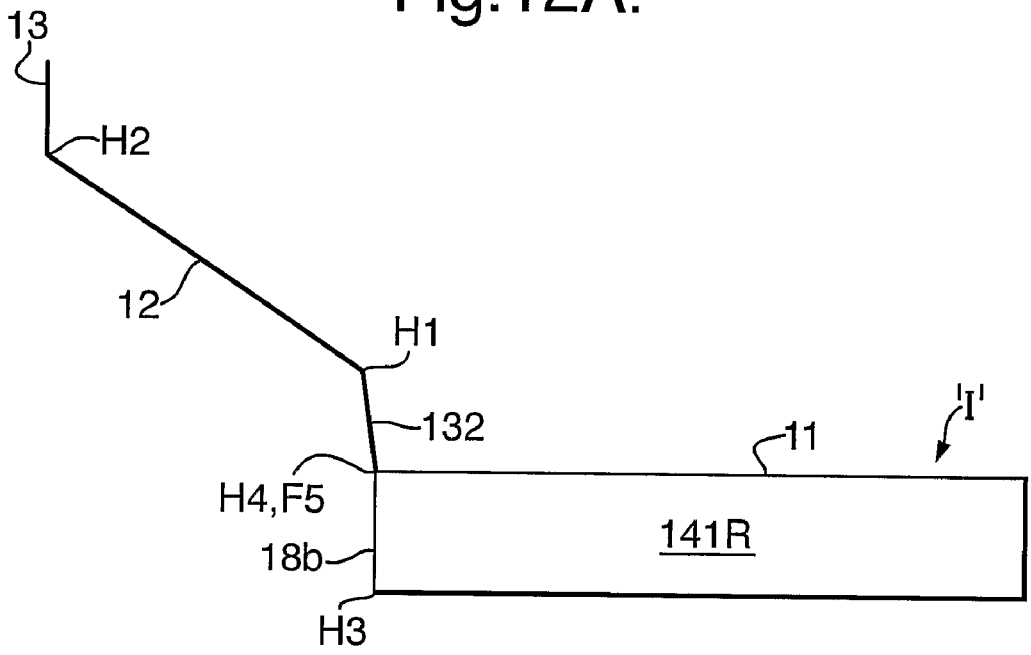
Figure 12B:
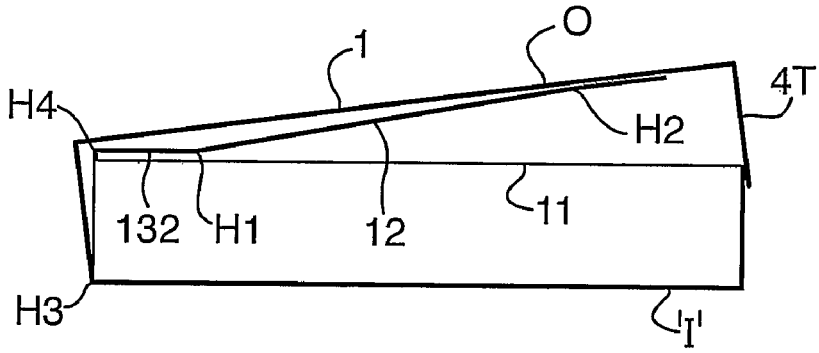
Figure 13:
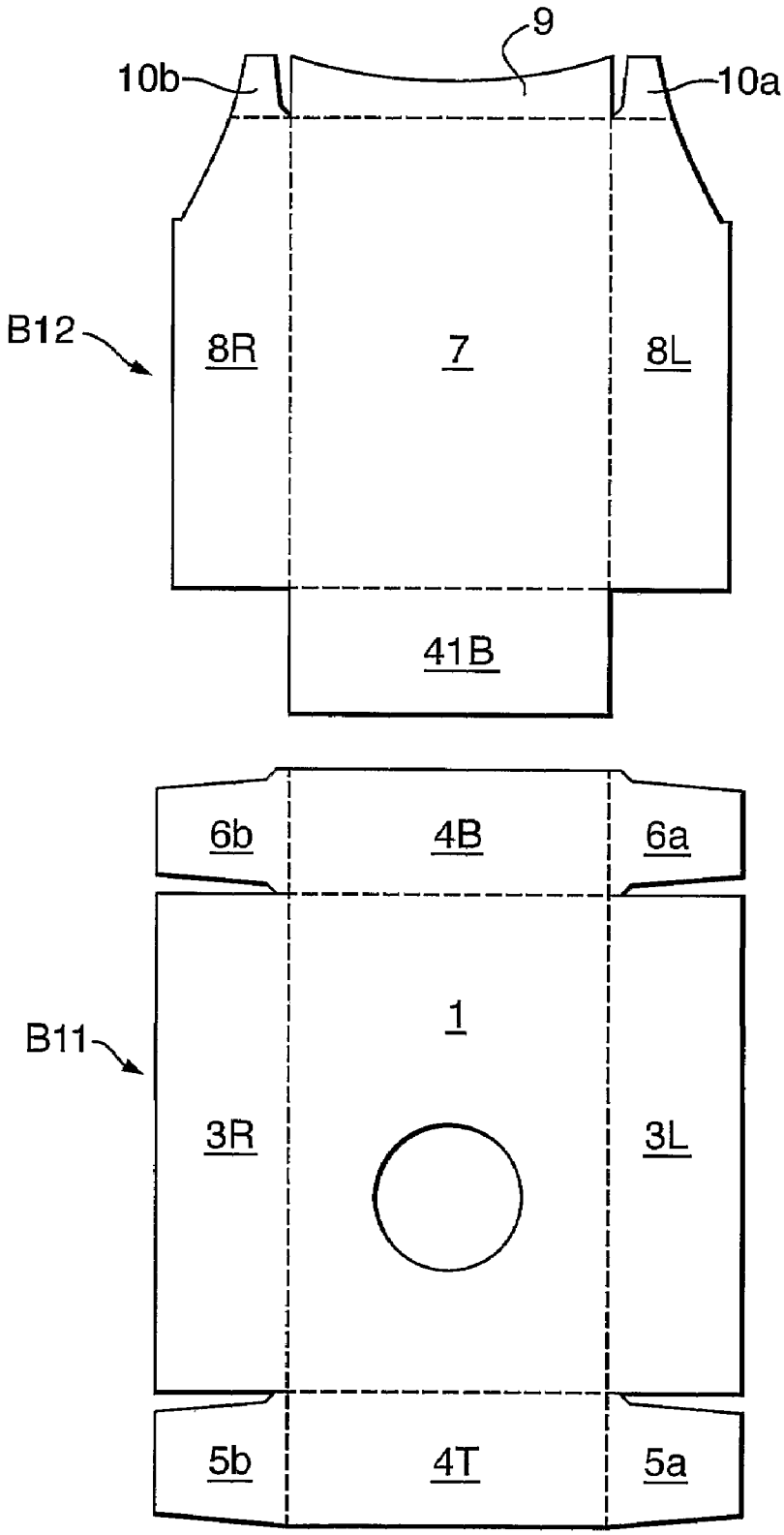

FIG. 12A is a side view of the inner shell I and spring member 12 of a fourth example of the packet. The inner shell I and spring member 12 of FIG. 12A is identical to that of FIGS. 7 to 10 except that the member 132 is not glued to the front wall 11 of the inner shell I. Thus the fourth example has four hinges, H1, H2, H3 and H4. Hinges H1, H2 and H3 are identical to the same referenced hinges of the first, second and third examples. Hinge H4 is at fold line F5 of FIG. 9. The effect of hinge H4 is that, referring to FIG. 12B, starting from a closed position, initially the spring action described above occurs with member 132 held against the front wall of the inner shell I, only the hinges H1, H2 and H3 operating. Eventually, the outer shell and spring member 12 pivot about hinges H4 and H3 allowing the outer shell to move freely unhindered by the spring action. This allows the outer shell to open to an angle greater than 180 degrees relative to the inner shell.

Modifications and Variants

Fifthe Example

FIG. 13

The fifth example is identical to the first example except the blank B1 is replaced by two blanks, B11 and B12.

Blank B12 has a flap 41B which, in use, is glued to flap 4B of blank B11 to form an assembled blank corresponding to that of FIG. 3.

The blanks of FIGS. 5 and 8 could likewise be replaced by two blanks which, in use, are glued together.

Providing a total of three blanks in this way allows the outer shell O and the inner shell I to be formed separately.

Indicia and Graphics

Indicia and/or graphics may be provided on any of the outside walls of the inner and outer shells. In addition or alternatively, indicia and/or graphics may be provided on the inner front wall 11 of the inner shell I and/or on any inner the surface of the packet visible when the packet is opened, for example on the spring member 12 and/or on the inner face of the front wall 1 of the outer shell O.

Contents

Packets in accordance with the invention may contain smoking articles, for example cigarettes, cigars and cigarillos. Packets in accordance with the invention may be used to contain objects other than smoking articles. The packets may be used for other generally elongate cylindrical objects for example pencils and crayons. The packets may be used to store other objects which are not generally elongate and/or cylindrical.

Shape of Edges

The packets described by way of example all have rectangular edges. That is not essential to the invention: the packets may have edges at least between the side walls and the front and rear walls which are rounded, bevelled, or elliptical, or other edge shapes including those known in the art.

Modified Blank

Figure 11:
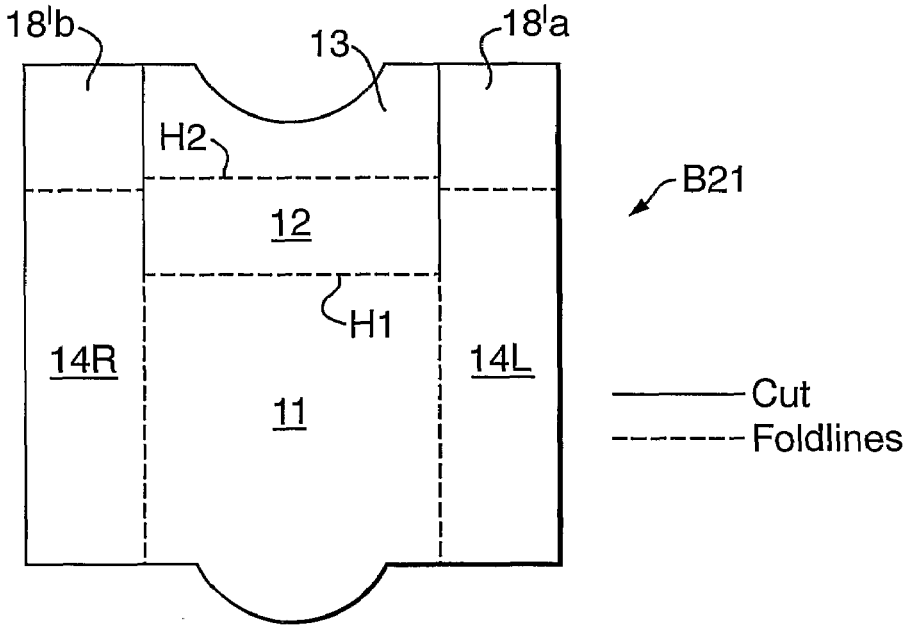

The blank B2 of FIGS. 4 and 5 may be modified as shown by blank B21 of FIG. 11. The blank B21 has flaps 18'*a* and 18'*b* corresponding to flaps 18*a* and 18*b* of FIG. 9 and which serve the same purpose.

Support of Contents

As described above, the bundle of cigarettes is supported by the bottom wall of the outer shell. However, in an alternative arrangement the flaps on the side walls of the inner shell may be turned inwardly to support the bundle. Furthermore, the bundle may be glued in place in the inner shell so that movements of the outer shell (particularly the bottom thereof) does not mean that the bundle also moves.

The invention claimed is:

1. A packet comprising:

an outer shell and an inner shell connected by a spring member;

the outer shell defining a cavity for receiving the inner shell and comprising a top wall, a bottom wall having four sides defining four edges, a front wall having an inner surface and two side walls upstanding from respective edges of said bottom wall;

the inner shell comprising a front wall having a lower portion adjacent said bottom wall, a rear wall and two side walls, said rear wall being connected with said bottom wall of said outer shell;

said spring member being hinged relative to said front wall of said inner shell by a first hinge at the said lower portion of said front wall of said inner shell and being hingedly connected by a second hinge at an upper edge of said spring member to a relatively upper position on said inner surface of said front wall of said outer shell as compared to the position of said first hinge, said upper edge of said spring member being spaced by a substantial distance from said top wall of said outer shell;

said inner shell being hingedly connected to said outer shell by a third hinge at the said bottom wall of said outer shell;

the sum of a) the spacing of said first hinge from said second hinge and b) the spacing of said first hinge from said third hinge being greater than the spacing of said second hinge from said third hinge when said inner shell and said outer shell are between their open and closed positions, whereby said inner shell is caused to spring between said open position in which it is out of said outer shell wherein contents of said inner shell are accessible, and said closed position in which it is within said outer shell wherein the said contents are inaccessible.

2. A packet according to claim 1, wherein said third hinge is at that one of said edges of said bottom wall of said outer shell from which said front wall and said sidewalls of said outer shell do not upstand.

3. A packet according to claim 1, wherein said third hinge is parallel to, but intermediate, said edge of said bottom wall from which said front wall of said outer shell upstands, and the edge of said bottom wall opposite thereto.

4. A packet according to claim 1, wherein said outer shell has a said top wall which in the closed position of said inner shell fits snugly to a top wall of said inner shell.

5. A packet according to claim 4, wherein said top wall of said outer shell is coextensive with, and connected to, the said front and side walls of said outer shell.

6. A packet according to claim 4, wherein said rear wall of said inner shell is slightly longer by an amount X than said side walls of said inner shell, thereby providing a said rear wall portion of length X adjacent said third hinge so that when said inner shell is moved by said spring member from its open position to its closed position said spring member lifts the said top wall of said outer shell over said top wall of said inner shell.

7. A packet according to claim 1, wherein said inner shell has a top wall connected to the said rear and side walls thereof and which is coextensive with the said rear wall thereof

8. A packet according to claim 7, wherein the top of said front wall of said inner shell is spaced from said top wall of said inner shell thereby to define an opening for accessing the contents of said packet, which said opening is closed by said outer shell in the closed position of said inner shell.

9. A packet according to claim 7, wherein said top wall of said inner shell has a recess for facilitating access to the contents of said inner shell.

10. A packet according to claim 1, comprising reinforcement of the said lower portion of said front wall of said inner shell at the said first hinge.

11. A packet according to claim 1 where the length of said spring member is such that in the open position said inner shell is at an angle in the range of about 5 to 180 degrees to said outer shell.

12. A packet according to claim 1, wherein the length of said spring member is such that in the open position said inner shell is at an angle in the range 40 to 90 degrees to said outer shell.

13. A packet according to claim 1, wherein the length of said spring member is such that in the open position said inner shell is at an angle in the range 20 to 40 degrees to said outer shell.

14. A packet according to claim 1 wherein said spring member is of cardboard comprising fibres and the direction of said fibres of said cardboard of said spring member is parallel to said side walls of said inner and outer shells.

15. A packet according to claim 1 wherein said spring member is hingedly connected by said first hinge at a lower edge of said spring member to the lower portion of said front wall of said inner shell.

16. A packet according to claim 1, wherein said rear wall of said inner shell is integral with said bottom wall of said outer shell.

17. A packet according to claim 1, wherein: said spring member and said front wall of said inner shell are integrally formed from one blank; and said outer shell and at least said rear wall of said inner shell are integrally formed from another blank.

18. A packet according to claim 17, wherein said packet is constructed to contain a bundle of elongate objects, and the said one blank comprises flaps which are arranged to fold adjacent the bottom of said bundle of elongate objects to aid the positioning of said bundle of elongate objects relative to the said one blank during assembly of said packet.

19. A packet according to claim 1 wherein said spring member and said front wall of said inner shell are integrally formed from one blank.

20. A packet according to claim 1, wherein said outer shell is formed from one blank and said inner shell is formed at least in part from another blank, the said one and said other blank being fixed to each other at said bottom wall.

21. A packet according to claim 1, wherein the said first hinge is between the said spring member and a further member hingedly connected at a fourth hinge to said front wall of said inner shell.

22. A packet according to claim 1, wherein said second hinge is between said spring member and a flap fixed to said inner surface of said front wall of said inner shell, the said flap extending from said hinge towards the said bottom wall.

23. A packet according to claim 1, wherein said front wall of said outer shell has an aperture positioned so a user can engage said front wall of said inner shell with the user's finger to move said inner shell from its closed position to its open position and wherein said upper edge of said spring member is intermediate said aperture and said bottom wall.

24. A packet according to claim 1, comprising recesses in the respective said side walls of said outer shell to allow the user to grasp said side walls of said inner shell to move it out of said outer shell.

* * * * *

UNITED STATES PATENT AND TRADEMARK OFFICE

CERTIFICATE OF CORRECTION

PATENT NO. : 7,681,727 B2
APPLICATION NO. : 11/792568
DATED : March 23, 2010
INVENTOR(S) : Hunt et al.

It is certified that error appears in the above-identified patent and that said Letters Patent is hereby corrected as shown below:

Column 5, line 51, delete “frill” and insert -- full --;
Column 7, line 61, delete “R1” and insert -- RL --;
Column 8, line 32, delete “B2” and insert -- B2" --;
Column 8, line 36, delete “R1” and insert -- RL --;
Column 9, line 16, delete “Fifthe” and insert -- Fifth --; and,
Column 10, line 63, insert a -- . -- after “thereof”;

Signed and Sealed this
Fifteenth Day of March, 2011

David J. Kappos

David J. Kappos
*Director of the United States Patent and Trademark Office*